United States Patent [19]

Sato et al.

[11] Patent Number: 4,915,506

[45] Date of Patent: Apr. 10, 1990

[54] APPARATUS FOR DRYING MATERIAL WHICH IS MIXED WITH A SOLVENT

[75] Inventors: Isao Sato; Antonius M. Van Aken, both of Doetinchem, Netherlands

[73] Assignee: Hosokawa Micron Europe B.V., Doetinchem, Netherlands

[21] Appl. No.: 233,803

[22] Filed: Aug. 18, 1988

[30] Foreign Application Priority Data

Sep. 10, 1987 [EP] European Pat. Off. ..... 87201734

[51] Int. Cl.[4] ..... B01F 7/08; F26B 3/347; F26B 17/18

[52] U.S. Cl. ..... 366/146; 366/192; 366/287; 366/318; 34/1; 34/179;

[58] Field of Search ..... 366/4, 7, 22–25, 366/41.50, 64, 79, 144, 146–148, 192, 193, 287, 288, 292, 294, 297, 318, 320, 331; 34/1, 66, 179, 181–183; 219/10.55 D

[56] References Cited

U.S. PATENT DOCUMENTS

| | | | |
|---|---|---|---|
| 2,958,754 | 11/1960 | Hahn | 219/10.55 D |
| 3,602,486 | 8/1971 | Nauta | 366/292 |
| 3,736,399 | 5/1973 | Jarvis | 219/10.55 D |
| 3,742,176 | 6/1973 | Ishino et al. | 219/10.55 D |
| 3,775,863 | 12/1963 | Updegrove | 366/287 |
| 4,003,554 | 1/1977 | Chauffoureaux | 366/146 |
| 4,044,279 | 8/1977 | Tsuzurahara et al. | 219/10.55 D |
| 4,132,239 | 1/1979 | Bowen et al. | 219/10.55 D |
| 4,281,072 | 7/1981 | Wetton et al. | 219/10.55 D |
| 4,390,768 | 6/1983 | Teich et al. | 219/10.55 D |
| 4,422,722 | 12/1983 | Baumgartner | 366/331 |
| 4,547,642 | 10/1985 | Smith | 219/10.55 D |
| 4,631,214 | 12/1986 | Hasegawa | 219/10.55 D |
| 4,671,757 | 6/1987 | Volk, Jr. | 366/146 |
| 4,711,979 | 12/1987 | Glasser et al. | 219/10.55 D |

*Primary Examiner*—Harvey C. Hornsby
*Assistant Examiner*—Joseph S. Machuga
*Attorney, Agent, or Firm*—Bauer & Schaffer

[57] ABSTRACT

Apparatus for drying material which is mixed with a solvent. Material and solvent are mixed in a mixer (1) and simultaneously vibration energy is radiated by one or more high frequency vibration generators (9) towards the free surface (10) of the mixture mass in the container with a frequency of 2450 MHz.

Thereby the solvent, which is a polar material, is heated and vaporized so that a quick drying of the product is obtained without damage thereto.

The structure of the apparatus is such that also when no product is present leakage radiation remains within the safety limits and a minimal reflection of the radiated energy within the apparatus takes place.

16 Claims, 1 Drawing Sheet

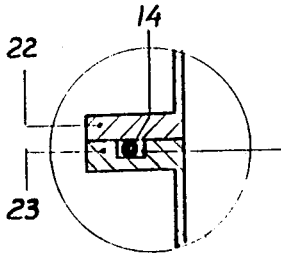
FIG. 2
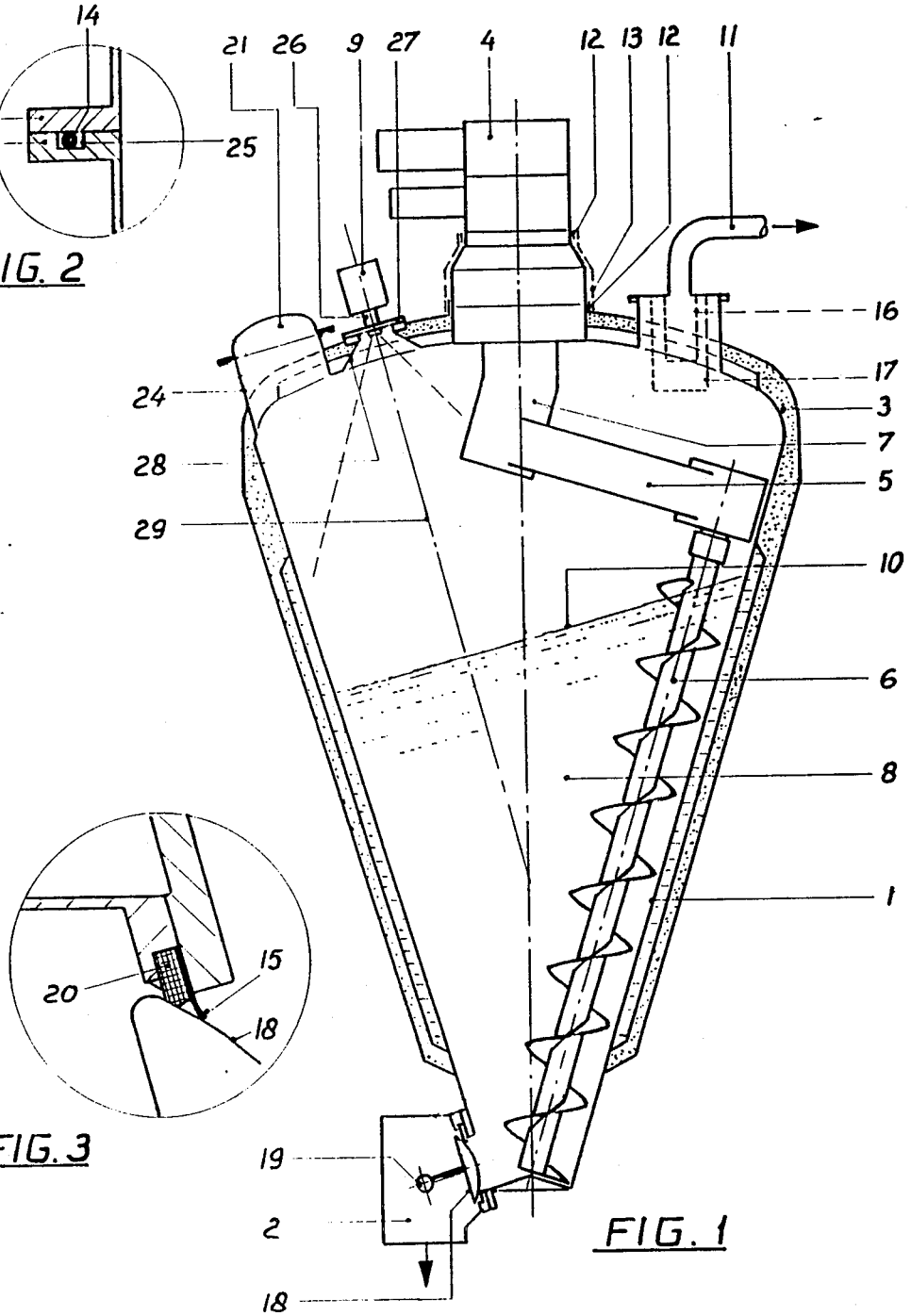
FIG. 1
FIG. 3

APPARATUS FOR DRYING MATERIAL WHICH IS MIXED WITH A SOLVENT

The invention relates to a mixing and drying apparatus for powdery, pasty of granular material, containing a solvent, said apparatus comprising a metallic conical mixing container having a rotatable mixing screw, one or more magnetrons being provided in the cover of the mixing container.

A similar apparatus is known from the No. EP-A-01871713 and is used for mixing and drying of various materials, e.g. in the food product, pharmaceutical and cosmetic industries. Therein high frequency vibration energy is radiated by the magnetron towards a free surface of the mass in the container during continuous mixing in the container, whereby subsequently all the solvent present in the mass is heated and vaporizes.

Because high frequency vibration energy is only absorbed by molecules having a dipole and of about 95% of the solvents used in the industry the molecules have a dipole or otherwise stated are polar substances, the solvent and the product are being quickly heated. Now also with a low wall temperature energy input is possible, so that also temperature sensitive substances can be dried.

However, said mixers having a magnetron have the disadvantage that with injudicious construction high frequency vibration energy reaches places where this is unallowable, namely outside the mixer, which is dangerous for the people working there, or is radiated backwardly through reflection towards the magnetron wave tube. Although there usually water cooling is provided as a protection of the wave tube, thereby rather much energy is lost. This also applies to the energy escaping outside the container.

The purpose of the invention is to improve the existing mixing apparatus. This is achieved according to the invention in that at the position of throughgoing apertures between the interior of the mixing container and the surrounding atmosphere, protection means against leakage towards the atmosphere of high frequency beams emitted by the magnetron(s) are provided.

One throughgoing aperture is that at the position of the lantern piece of the housing of the mixing screw drive.

According to the invention around an apertured piece (lantern piece) of the housing of the mixing screw drive a metallic basket has been provided, which at its lower and upper edges is sealed relative to the drive housing by a sealing ring comprising a network of fine metal wires, particularly of a nickel-copper-alloy. This network is radiation-tight.

Radiation could also escape through the discharge conduit for the solvent vapour. Although usually a cloth filter is provided before this conduit in order to retain product particles which have been carried along, which filter may comprise a metallic basket, this is not suitable as a protection against radiation. For it is that the apertures in this basket have to be so large, that the cloth may enter said apertures and can leave them again (under the influence of suction and pressurization) for the cleaning of the cloth. In that case said apertures pass the radiation.

In order to prevent this according to the invention within the cloth filter basket, a metal inner basket and having smaller apertures than the apertures present in the cloth filter basket is provided.

If the mixing apparatus has a pivotable discharge valve in or adjacent to the container bottom and having a metallic closure element sealing against a sealing ring made of synthetic material and provided in the discharge passage, radiation may escape through the seal. This is impossible according to the invention if adjacent to the sealing ring a metallic scrape ring is provided, which resiliently engages the valve closure element.

For the inspection of the interior of the mixing container one or more passages with man hole cover have been provided in the mixer cover or wall, provided with an o-ring for sealing the man hole cover. Since therewith it is not sure that always the cover flange and the container hole flange make full metallic contact, the invention proposes to make the o-ring radiation-tight. This is achieved according to the invention if the o-ring is radiation tight in that it is manufactured from silicone rubber impregnated with silver.

In order to restrict reflection towards the wave tube of the magnetron as much as possible, it has appeared to be advantageous if according to the invention the magnetron wave tube extends from the wave generator directly through the mixer cover and has a conically or pyramidally widening portion ending flush with the inner side of the cover. Also it is preferable if the magnetron axis is perpendicular to the cover.

The invention will be further explained below with reference to the drawing in which a mixing apparatus according to the invention is schematically shown as an example.

FIG. 1 shows a longitudinal section through the mixer.

FIG. 2 is a detail of a man hole,

FIG. 3 is a detail of a valve.

The mixing apparatus shown has a conical mixing vessel 1, having a discharge sprout 2 and provided with an upper cover 3 closing the mixing container. A drive unit 4 is mounted on the cover, said unit comprising an electromotor and transmission means to which inside the container a pivotable arm 5 is connected carrying a mixing screw 6. The drive and transmission means are such that the mixing screw 6 may be rotated due to the rotation of the output shaft 7 of the drive 4 along the interior of the conical wall of the mixing container 1 and also the mixing screw 6 may be rotated around its own axis.

A product mass 8 is present within the container 1 and comprises powdery, pasty or granular material mixed with a liquid solvent. Due to the operation of the mixing screw 6 said product mass may be mixed into a homogeneous mass. The container wall may or may not be heatable through a double-walled embodiment in which a liquid heating fluid is received and circulated respectively.

In a position on the exterior of the mixing container a magnetron or high frequency generator 9 is secured. In the embodiment shown the magnetron 9 is provided on the cover 3 of the mixer. Different locations as well as more than one magnetron 9 belong to the possibilities.

If electrical energy is supplied to the magnetron 9 it is converted thereby into electromagnetic energy, which is radiated with high frequency towards the product. Said energy penetrates by a predetermined penetration depth from the free product surface 10 (the boundary layer between the space occupied in the container by the product mass and the space over it). Thereby the molecules of the solvent, which is a polar material, are induced into strong movements whereby the vibration energy is converted into heat. This heat vaporizes the solvent, which escapes through the boundary layer 10 and is discharged or exhausted by suction from the mixing container 1 through a conduit 11. Said solvent may later on be recondensed in order to be reusable.

The vibration energy issued by the magnetron 9 is proportional to the frequency thereof and to the dielectrical constant of the solvent. The frequency is selected in the order of 2450 MHz and preferably at exactly this value in connection with frequences adjacent said value which are used by radio-emitters.

The penetration depth of the high frequency waves in the surface of the mass is larger according as the frequency and the dielectrical constant of the product material and the solvent respectively are smaller.

In order to prevent that radiation leaves the mixing container the following steps are taken according to the invention. Metallic walls are impervious for the radiation, at least in a thickness from 1 mm, but reflect the radiation.

Since the housing of the drive unit 4 may partially have outward apertures, e.g. in the embodiment of a so-called lantern piece, in order to prevent passing o radiation, a metallic basket 13 has to be provided around this lantern piece. This basket may be manufactured from perforated or not perforated metal sheet or from wire mesh. At the upper end and at the lower end the opening between the basket and the housing of the unit 4 likewise has to be sealed. There a sealing ring 12 is provided, comprising a network of fine wires, particularly of a nickel copper alloy, particularly Monel metal. This material is radiation tight.

In order to prevent that radiation reaches the discharge conduit 11 the following step has been taken. Around the position where the conduit 11 is joined with the container, inside this container generally a filter basket 17 with clothfilter is provided in order to prevent that product particles leave the container together with the solvent vapour. This basket 17, usually a metal basket having apertures, has apertures of such large size that the filter cloth is permitted to move into and out of said apertures if for cleaning air pressure is connected to the conduit 11 whereby the cloth moves outwardly, while if a vacuum is connected to the conduit 11, the cloth moves inwardly into the filter basket apertures. Thereby product particles, which have collected on the outside of the cloth fall back into the container.

However, for said cleaning function said basket apertures have to be of such size that they are too large to prevent that radiation reaches the conduit 11 and therefore according to the invention a metallic inner basket 16 has been provided inside the cloth filter basket 17 around the conduit mouth 11. Said basket 16 has smaller apertures which pass the vapour but not the radiation.

At the lower end of the container a valve has been provided in order to permit the discharge of the mixed and dried product. This valve may be provided in the side wall of the mixing container, such as the valve 18 as shown in FIG. 1, but also in the container bottom. A so-called ballsegment valve has been shown having a metallic ballsegment, which may be pivoted around a fulcrum 19 into the open and closed positions.

FIG. 3 shows at an enlarged scale a sealing ring 20 provided around the container opening, which is engaged by the ballsegment of the valve 18.

On or beside the sealing ring 20 a scrape ring 15 made of metal, e.g. stainless steel, is provided which resiliently engages the ball segment so that the container aperture is completely sealed by metal, so that also here the radiation cannot leave the container.

At least one man hole is provided in the container, in order to permit inspection of the interior of the container without having to release the complete cover. In the embodiment shown a man hole having a man hole cover 21 has been provided in the container cover 3. This man hole cover has a flange 22 (see the enlarged detail in FIG. 2) which is secured with bolts (not shown) to the flange 23 of a pipe portion 24 extending from the cover 3. Since it is not always sure that both flanges are completely in metallic contact, an o-ring 14 has been provided in a groove 25 in the pipe flange 23 for maintaining the sealing (e.g. against the vacuum in the mixing container). Since the radiation may pass said o-ring if there is not full metallic contact between the flanges, if this is an o-ring of customary material, the o-ring 14 is according to the invention manufactured from a special radiation type material, e.g. silicone rubber impregnated with silver.

A portion of the radiation energy maybe reflected towards the magnetron itself and then will heat its wave tube. In order to prevent possible heat damage to the magnetron 9 it is usual to provide the magnetron with water cooling. However, it has appeared that with the known mixers of this type up to 40% of the emitted vibration energy is reflected towards the magnetron and thereby is lost for action on the product. According to the invention much less reflection towards the magnetron is achieved if the wave tube 26 opens via a metallic flange 27 directly into a through going opening in the mixing container cover 3 and if this opening has a conically or pyramidally widening portion 28 ending flush with the interior side of the cover. Furthermore the axis 29 of the magnetron has to be substantially perpendicular to the cover 3, whereby again as little energy as possible is reflected towards the wave tube.

Although the drawing shows a conical mixer, the features of the invention are also applicable to other types of mixers. The rotation axis of the mixing container may extend horizontally as well as vertically.

The vaporization of the solvent is furthered by a stronger vacuum in the exhaust conduit 11. This may be adjusted dependent on the nature of the product. It would also be possible to just let the vapour flow off through the conduit 11, e.g. with a zero vacuum.

We claim:

1. Apparatus for mixing and drying powdery, pasty, or granular material containing a solvent, comprising a container for holding a quantity of said material, a rotatable mixing screw extending through said container into said material and a cover for closing said container, said cover having at least one magnetron mounted thereon for emitting through a passage in said cover high frequency energy into said container, a passage for removal of vapors created during the mixing and drying of said material and means passing through said cover for driving and moving said mixing screw, including means for sealing the passages through which said magnetron, drive means and vapors pass through said cover, against leakage into the atmosphere of high energy beams emitted by said magnetron, said means for driving said mixing screw being surrounded by a metallic wire mesh basket sealed at its ends to said drive means and said cover by rings having a network of fine metallic wires embedded therein.

2. The apparatus according to claim 1 wherein said wire mesh is formed of a nickel copper alloy.

3. The apparatus according to claim 1 wherein the vapor passage is sealed by a cloth filter basket and a metallic filter basket located therein, said metallic filter basket having apertures smaller than the apertures in said cloth filter basket.

4. The apparatus according to claim 1 including a material discharge outlet at the bottom of said container having valve means comprising a metallic closure and a resilient seal ring against which said metallic closure seats including a metallic scraper mounted adjacent said resilient seal ring for slidably engaging the surface of said metallic closure to seal said metallic closure from leakage of radiation.

5. The apparatus according to claim 1 wherein said cover is provided with at least one man hole having a cover plate sealed with said cover by an O-ring seal, said O-ring seal being formed of silicone rubber impregnated with silver so as to deflect radiation.

6. The apparatus according to claim 1 wherein said magnetron includes a wave tube extending from a wave generator, said wave tube passing through a conically widening opening in said cover and termination flush with the interior surface of said cover.

7. The apparatus according to claim 6 wherein said magnetron is sealed by a metal plate interposed between said wave generator and said conical opening.

8. The apparatus according to claim 6 wherein the axis of said wave tube is perpendicular to the surface of said cover.

9. Apparatus for mixing and drying powdery, pasty, or granular material containing a solvent, comprising a container for holding a quantity of said material, a rotatable mixing screw extending through said container into said material and a cover for closing said container, said cover having at least one magnetron mounted thereon for emitting through a passage in said cover high frequency energy into said container, a passage for removal of vapors created during the mixing and drying of said material and means passing through said cover for driving and moving said mixing screw, including means for sealing the passages through which said magnetron, drive means and vapors pass through said cover, against leakage into the atmosphere of high energy beams emitted by said magnetron, said means for driving said mixing screw being surrounded by a metallic wire mesh basket sealed at its ends to said drive means and said cover by rings having a network of fine metallic wires embedded therein and wherein said vapor passage is sealed by a cloth filter basket and a metallic filter basket located therein, said metallic filter basket having apertures smaller than the apertures in said cloth filter basket.

10. The apparatus according to claim 9 including a material discharge outlet at the bottom of said container having valve means comprising a metallic closure and a resilient seal ring against which said metallic closure seats including a metallic scraper mounted adjacent said resilient seal ring for slidably engaging the surface of said metallic closure to seal said metallic closure from leakage of radiation.

11. The apparatus according to claim 9 wherein said cover is provided with at least one man hole having a cover plate sealed with said cover by an O-ring seal, said O-ring seal being formed of silicone rubber impregnated with silver so as to deflect radiation.

12. The apparatus according to claim 9 wherein said magnetron includes a wave tube extending from a wave generator, said wave tube passing through a conically widening opening in said cover and terminating flush with the interior surface of said cover.

13. The apparatus according to claim 12 wherein said magnetron is sealed by a metal plate interposed between said wave generator and said conical opening.

14. The apparatus according to claim 13 wherein the axis of said wave tube is perpendicular to the surface of said cover.

15. The apparatus according to claim 9 wherein the means for driving said mixing screw is surrounded by a metallic wire mesh basket sealed at its ends to said drive means and said cover by rings having a network of fine metallic wires embedded therein.

16. The apparatus according to claim 15 wherein the wire mesh is formed of a nickel copper alloy.

* * * * *